United States Patent [19]

Meng

[11] Patent Number: 4,854,818

[45] Date of Patent: Aug. 8, 1989

[54] SHROUDED INDUCER PUMP

[75] Inventor: Sen Y. Meng, Reseda, Calif.

[73] Assignee: Rockwell International Corporation, El Segundo, Calif.

[21] Appl. No.: 138,465

[22] Filed: Dec. 28, 1987

[51] Int. Cl.[4] ..... F04D 29/66

[52] U.S. Cl. ..... 415/58.4; 415/58.5

[58] Field of Search ..... 415/11, 53 R, DIG. 1, 415/119, 144, 115, 143, 168, 169 R, 169 A, 199.6; 416/181, 189, 191, 192

[56] References Cited

U.S. PATENT DOCUMENTS

| | | | |
|---|---|---|---|
| 2,984,189 | 5/1961 | Jekat | 415/143 |
| 3,221,661 | 12/1965 | Swearingen | 415/143 |
| 4,150,916 | 4/1979 | Tsutsui et al. | 415/143 |
| 4,375,937 | 3/1983 | Cooper | 415/53 R |
| 4,375,938 | 3/1983 | Dussard | 415/53 R |
| 4,449,888 | 5/1984 | Balje | 415/143 |
| 4,642,023 | 2/1987 | Dunn | 415/53 R |
| 4,708,584 | 11/1987 | Meng | 415/53 R |

FOREIGN PATENT DOCUMENTS

| | | | |
|---|---|---|---|
| 585315 | 12/1977 | U.S.S.R. | 415/143 |
| 62300 | 9/1978 | U.S.S.R. | 415/143 |

*Primary Examiner*—Robert E. Garrett
*Assistant Examiner*—Joseph M. Pitko
*Attorney, Agent, or Firm*—H. Fredrick Hamann; Harry B. Field; David C. Faulkner

[57] ABSTRACT

An improvement in a pump including a shrouded inducer, the improvement comprising first and second sealing means 32,36 which cooperate with a first vortex cell 38 and a series of secondary vortex cells 40 to remove any tangential velocity components from the recirculation flow.

3 Claims, 3 Drawing Sheets

SHROUDED INDUCER PUMP

STATEMENT OF GOVERNMENT INTEREST

The Government has rights in this invention pursuant to Contract (or Grant) No. DE-AC03-83SF11901 awarded by the U.S. Department of Energy.

BACKGROUND OF THE INVENTION

1. Field of the Invention

The present invention relates to centrifugal pumps and, more particularly, to a shrouded inducer for use with a centrifugal pump. The present invention is more particularly directed to eliminating the cavitation damage which normally would result from a recirculation flow of fluid about the shroud of the inducer.

2. Description of the Prior Art

The addition of a shroud to an otherwise shroudless inducer assists in preventing the formation of vortices at or about the tip of the inducer blades and thus minimizes the cavitation damage to the inducer associated with such vortices. The addition of a shroud, however, may cause a portion of the fluid downstream of the inducer to recirculate about the outer periphery of the shroud and then re-enter the main flow jets upstream of the inducer blade. As the recirculating fluid emerges from behind the forward or upstream edge of the shroud, it will often shed vortices which impinge directly upon the more radially outward portions of the inducer blades. These vortices create an erosive action upon portions of the blades and ultimately result in the inducer suffering a loss in efficiency and structural integrity. The use of a shroud to avoid the problems associated with blade tip vortices is exacerbated by the problems associated with vortices shed at the forward edge of the shroud.

Various attempts have been made to overcome the problems associated with recirculation flow about a shrouded inducer. For example, labyrinth seals have been placed about the outer periphery of the inducer shroud to minimize recirculation flow over the shroud. However, no matter how good the labyrinth seal, there is always some amount of flow which passes over the seal which will then cause the aforementioned vortices problem.

Moreover, as time goes by, labyrinth seals tend to lose their sealing effectiveness, especially in pumps where vibration and thermodynamics subject the seal to any degree of rubbing. An extensive use of labyrinth seals could be employed to reduce the circulation flow to a minimum such as suggested in U.S. Pat. No. 2,984,189. Such an extensive use of seals is impractical and costly. Various other methods have been proposed with regard to the construction of a shrouded inducer to overcome the problems associated with vortices emanating from the shroud.

OBJECTS OF THE INVENTION

It is an object of the present invention to provide a shrouded inducer which minimizes the cavitation damage resulting from fluid recirculating about the shroud.

Yet another object of the invention is to provide a shrouded inducer pump which will suffer no cognizable degree of cavitation damage either from tip vortices or from vortices shed by fluid being recirculated about the shrouded inducer.

Still another object of the invention is to provide a shrouded inducer pump in which fluid recirculated about the shroud may be reintroduced directly into the fluid inlet with minimal disruption of the inlet flow pattern.

SUMMARY OF THE INVENTION

The foregoing and other objects are accomplished by the present invention. Broadly, the invention comprises an improvement in a pump having a shrouded inducer including at least one spiral blade circumferentially surrounded by a shroud. The inducer is rotatably mounted within the pump housing. Typically, the housing will have a fluid inlet and a fluid outlet and there will be an annular space defined by an outer periphery of the shroud and adjacent surface of the housing which conveys a recirculation flow of fluid over the shroud during operation of the pump. The present invention provides an improvement for alleviating cavitation damage associated with such recirculation flow.

The improvement comprises a downstream inducer shroud raised annular lip;

a first seal means formed in the shroud housing and associated with said annular lip;

a structural vane including a second seal means, said second seal means associated with a downstream segment of the shroud;

an annular chamber formed downstream of the inducer blade;

a first vortex cell between said first seal means and said second seal means; and at least one secondary vortex cell formed by a downstream segment of the structural vane and the pump housing, said secondary vortex cell communicating with an annular chamber formed by said pump housing.

In accordance with one preferred embodiment of the invention, the pump includes at least one fluid passageway formed within the housing wall, which fluid passagway communicates with an upstream fluid source.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENT

Figure 2:
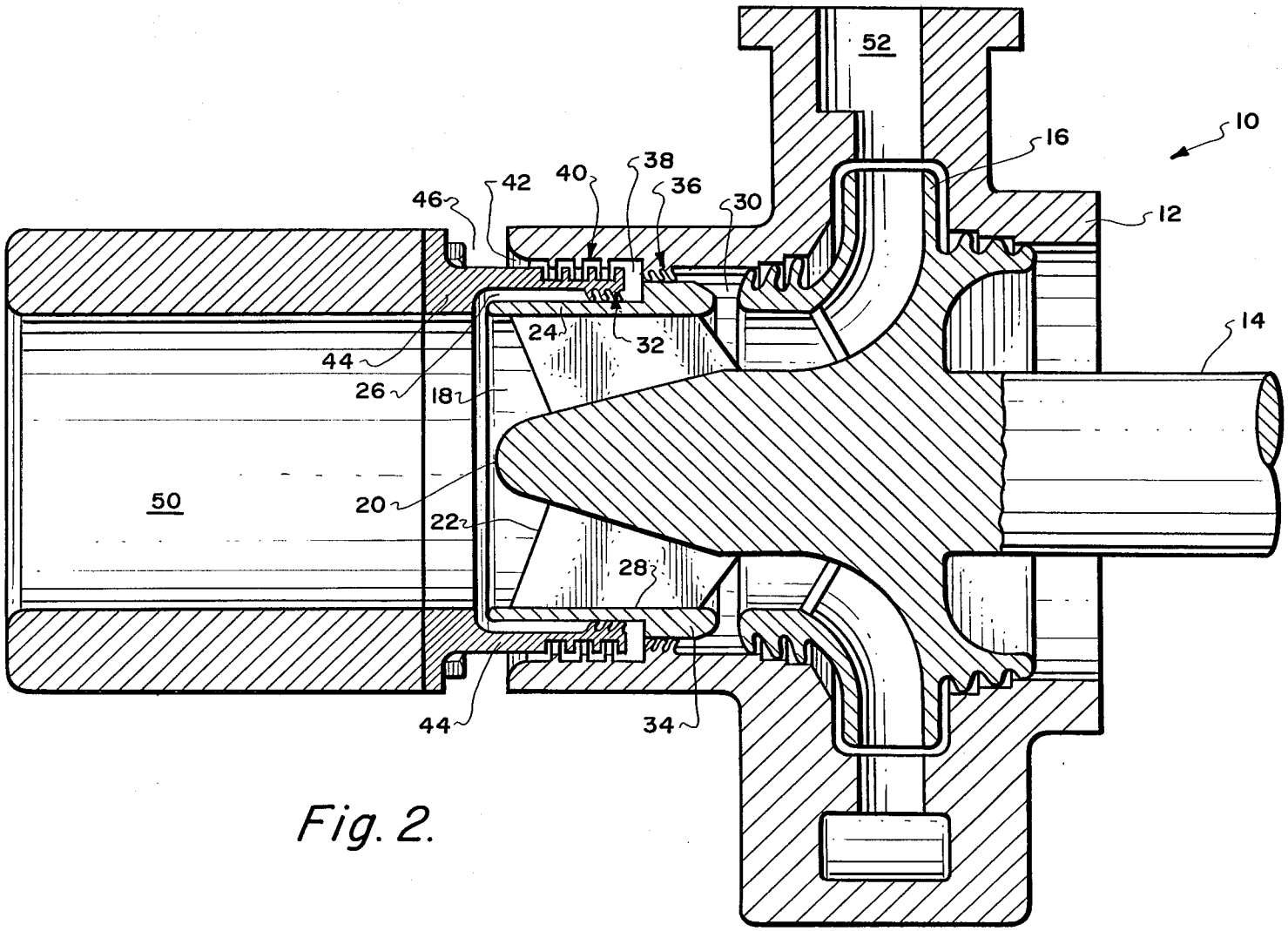
FIG. 2 is a schematic, cross-sectional side view of a centrifugal pump having a shrouded inducer constructed according to the preferred embodiment of the present invention.

Referring to FIG. 2, a preferred embodiment of the present invention is depicted comprising the essential elements of a submersible shrouded inducer pump 10 constructed in accordance with the present invention. The pump includes a housing 12 containing a rotatable rotor 14 provided with an impeller 16. A substantially cylindrical shroud member 18 is attached at the outer edge 28 of blades 22 and surrounds blades 22. As depicted, shroud member 18 includes a downstream raised annular lip 34. Within housing 12 there is formed one labyrinth sealing means 36 which is associated with raised lip 34. A second labyrinth seal means 32 is formed in the downstream portion of structural vane 44. Intermediate the first labyrinth seal means and impeller 16 is annular chamber 30. A first vortex cell 38 is formed by a surface of housing 12 and shroud inducer 24 intermediate sealing means 32 and 36. Just downstream of the first vortex cell 38 are a series of secondary vortex cells 40. The purpose of seal means 32,36 and vortex cell 38 as well as secondary vortex cells 40 is to minimize the flow of recirculation fluid which would normally flow around shroud 18 through annular passageway 26 (see FIGS. 2 and 3) defined by outer surface of shroud 24 and the adjacent inner surface 44.

Annular space 42 defined by an outer surface of structural vane 44 and the adjacent inner surface of housing 12 provides fluid communication between annular space 26, annular chamber 30 and annular chamber 46.

In operation, torque is applied to rotor 14 from an external power source (not shown). As fluid is introduced through the inlet 50 of housing 12, blades 22 impart a swirl pattern favorable to the pumping operation of, for example, the impeller of a centrifugal pump, the latter of which increases the pressure of the fluid and discharges it into an outlet volute 52 of housing 12. A portion of the incoming fluid passing blades 22, especially that portion just upstream of blades 22, tends to enter the annular space 26 defined between the outer periphery of shroud 24 and structural vane 44. At the same time incoming fluid entering annular chamber 30 is ultimately caused to exit at volute 52 by the action of impeller 16 in concert with the shrouded inducer 18.

Figure 3:
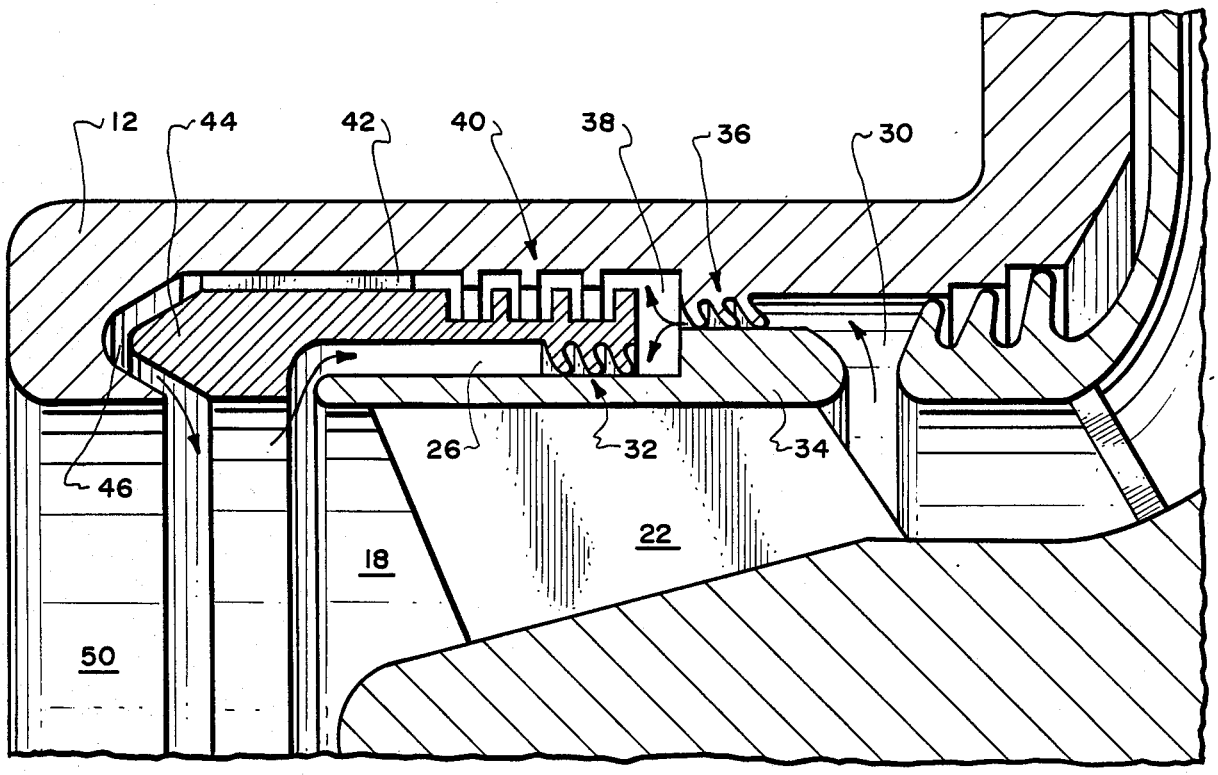
FIG. 3 is a cross-sectional side view of an alternate embodiment of a vortex-proof inducer constructed in accordance with the present invention.

In the embodiments of FIGS. 2 and 3, and as indicted by the arrows in FIG. 3, which depicts a non-submersible shrouded inducer pump, the pressure differential existing between the fluid leaking through passageway 26, past seal means 32 and into vortex cell 38 is caused by an amount of fluid passing into annular chamber 30 and through sealing means 36 to combine with the aforementioned fluid in vortex cell 38. As will be discussed in more detail hereinbelow, the fluid from vortex cell 38 is then flowed through secondary vortex cells 40, annular space 42 and to concave annular chamber 46 where it can be reintroduced into the main inlet fluid stream. As seen in FIG. 2, fluid from chamber 46 is routed back into the inlet fluid source as opposed to flowing back into the fluid inlet stream at blades 22 as in the embodiment shown in FIG. 3. The source may be a molten metal pool such as found in a molten metal reactor or it might be a fuel reservoir such as utilized in a rocket engine.

Figure 1:
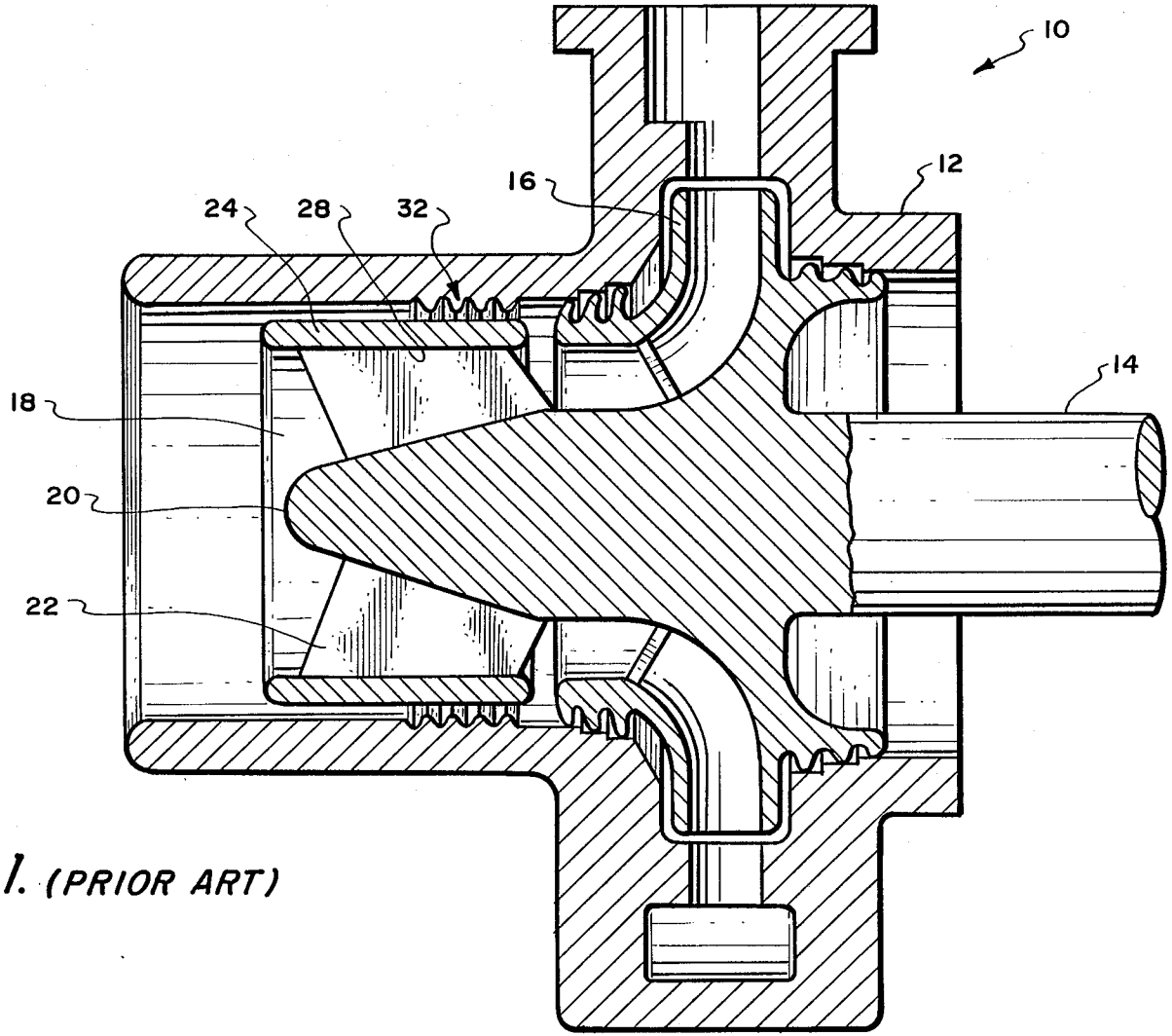
Fig. 1. (PRIOR ART)
FIG. 1 is a schematic cross-sectional side view of a centrifugal pump constructed according to the prior art.

The flow of fluid as just described should it occur in the prior art inducer shown in FIG. 1 would establish a flow that is herein referred to as a recirculation flow over the shroud, which in the absence of the present invention might cause cavitation damage to inducer blade 22. It must also be understood that the recirculation flow also produces a substantial tangential or swirl velocity component due to the rotational action of the shroud.

The present invention avoids cavitation damage and other problems mentioned above (See FIGS. 2 and 3), by providing a shortened inducer shroud 24 having a raised annular lip 34 at the downstream end of inducer shroud 24 which serves to form in part annular chamber 30. A first labyrinth sealing means 36 is defined by an inner surface of housing 12. The structural vane 44 includes labyrinth seal 32 which together with housing 12 and shroud 18 define vortex cell 38 and secondary vortex cells 40. Aforementioned passageway 42 communicates from the vortex cells 40 to annular chamber 46 for subsequent rerouting as described above.

In order to minimize recirculation flow and potential cavitation damage due to the recirculating fluid, a quantity of fluid from annular chamber 30 is caused to flow past seal means 36 into vortex cell 38 where it forms strong vortices therein. These vortices create a low pressure in the vicinity of seal 32. A quantity of fluid from inlet 50 flows through annular space 26 and is induced into vortex cell 38. There it mixes with the fluid flowing in from annular chamber 30. This mixture of fluids then flows through the secondary vortex cells 40 to further reduce whirl velocity before encountering structural vane 44 upstream of shrouded inducer 18.

The unique design of the present invention provides for sealing means which function in cooperation with a primary and secondary vortex cell arrangement to minimize the velocity at the structural inducer blades 22 thereby avoiding cavitation damage. The invention further results in a pump design with improved suction performance.

While the invention has been described broadly with respect to recirculated fluids, it will be appreciated by those versed in the art that it is equally applicable to liquids such as water, liquid metals used for coolant in reactors and propellants utilized for reaction engines. Indeed, a particularly preferred application of the present invention is with a rocket engine which operates at variable thrust levels. The present invention permits the pump to operate over a wide range of rotational speeds and pressure differential without cavitation than would otherwise be possible.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. In a pump having a shrouded inducer including at least one spiral blade circumferentially surrounded by a shroud, the inducer blade being rotatably mounted within a pump housing, said housing having a fluid inlet and a fluid outlet and wherein an annular space defined by an outer periphery of the shroud and an adjacent surface of the housing conveys a recirculation fluid over the shroud during operation of the pump, an improvement for alleviating cavitation damage associated with the recirculation flow, said improvement comprising in combination:

a downstream inducer shroud raised annular lip;

a first seal means formed in the housing and associated with said annular lip;

a structural vane including a second seal means, said second seal means associated with a downstream segment of the shroud;

an annular chamber formed downstream of the inducer blade;

a first vortex cell between said first seal means and said second seal means; and at least one secondary vortex cell formed by a downstream segment of the structural vane and the pump housing, said secondary vortex cell communicating with an annular space formed by said structural vane and said pump housing.

2. The pump of claim 1 further comprising at least one fluid conveying annular space formed within the housing walls, said fluid conveying annular space communicating with a concave annular chamber upstream of the structural vane and an upstream fluid source.

3. The pump of claim 1 wherein said first and second seal means comprise labyrinth seals.

* * * * *